US012571198B2

(12) United States Patent
Shen et al.

(10) Patent No.: US 12,571,198 B2
(45) Date of Patent: Mar. 10, 2026

(54) VERTICAL TOOL SHED

(71) Applicant: Linhai Sunrise Leisure Products Co., Ltd., Linhai City (CN)

(72) Inventors: Huaqiang Shen, Linhai City (CN); Yilun Liu, Linhai City (CN)

(73) Assignee: Linhai Sunrise Leisure Products Co., Ltd., Linhai City (CN)

( * ) Notice: Subject to any disclaimer, the term of this patent is extended or adjusted under 35 U.S.C. 154(b) by 0 days.

(21) Appl. No.: 19/087,723

(22) Filed: Mar. 24, 2025

(65) Prior Publication Data

US 2025/0215684 A1 Jul. 3, 2025

(51) Int. Cl.
*E04B 1/343* (2006.01)
*E04H 1/12* (2006.01)

(52) U.S. Cl.
CPC ..... *E04B 1/34317* (2023.08); *E04B 1/34321* (2013.01)

(58) Field of Classification Search
CPC ..... E04B 1/34315; E04B 1/34317; E04B 1/34321; E04B 1/6183
USPC ..... 52/79.5
See application file for complete search history.

(56) References Cited

U.S. PATENT DOCUMENTS 603,147 A * 4/1898 Lordly ..... E04C 2/292 312/265.5
2,293,569 A * 8/1942 Sonion ..... E04B 1/34317 52/459
2,838,592 A * 6/1958 Feketics ..... E04B 1/92 976/DIG. 335
3,020,601 A * 2/1962 Stambaugh ..... A47B 47/042 D25/16
RE25,827 E * 8/1965 Bigelow, Jr. ..... E04B 1/34336 52/64
3,470,657 A * 10/1969 Irwin ..... E04B 1/34315 52/27
3,818,661 A * 6/1974 Pragg, III ..... E04B 2/7854 52/282.4
4,637,179 A * 1/1987 Bigelow, Jr. ..... E04B 1/34321 52/79.5
RE32,890 E * 3/1989 DeFouw ..... A47B 83/001 52/239
5,319,896 A * 6/1994 Winger ..... E04B 7/00 52/DIG. 11

(Continued)

FOREIGN PATENT DOCUMENTS

AT 518642 B1 * 12/2017
CN 113482407 A * 10/2021

(Continued)

*Primary Examiner* — Brian D Mattei
*Assistant Examiner* — Joseph J. Sadlon

(57) ABSTRACT

The invention discloses a vertical tool shed which includes a top plate, a bottom plate, a back plate, side plates, door plates and upright columns, where an inner wall of the door plate is provided with a mounting plate, the mounting plate is provided with a hook assembly, an inner wall of the back plate is provided with a detachable storage plate assembly, and the inner wall of the back plate or an inner wall of the side plate is provided with a detachable hanging assembly. The invention provides a plurality of hook assemblies for hanging, which are not only simple in structure, but also detachably mounted, and adjustable in mounting position.

6 Claims, 7 Drawing Sheets

(56) References Cited

U.S. PATENT DOCUMENTS 5,941,026 A * 8/1999 Eisenreich ..... A47F 5/0846 52/12
5,975,660 A * 11/1999 Tisbo ..... A47B 47/045 312/265.2
D420,838 S * 2/2000 Riga ..... D6/675.3
6,058,660 A * 5/2000 Melton ..... E04H 6/04 52/36.5
6,099,092 A * 8/2000 Uffner ..... E05D 11/105 16/374
6,334,278 B1 * 1/2002 Arnold ..... E04H 9/06 52/79.5
6,446,414 B1 * 9/2002 Bullard, III ..... E04B 1/6179 52/282.1
6,539,674 B2 * 4/2003 Arnold ..... E04H 9/14 109/15
6,668,514 B2 * 12/2003 Skov ..... E04H 1/1205 52/592.1
6,679,008 B2 * 1/2004 Santa Cruz ..... E04H 9/12 52/270
6,681,510 B1 * 1/2004 Salatin ..... A47F 7/30 27/27
6,802,158 B1 * 10/2004 Greene ..... E04H 1/1205 52/36.2
7,134,250 B2 * 11/2006 Forrester ..... E04B 1/80 52/783.17
7,329,456 B2 * 2/2008 Tilton ..... A47B 81/06 493/69
7,509,776 B2 * 3/2009 Reisman ..... E04B 1/34315 52/489.1
7,581,357 B2 * 9/2009 Richardson ..... E04B 1/34321 52/79.5
8,109,044 B2 * 2/2012 Graber ..... A47K 3/30 52/36.2
8,161,706 B2 * 4/2012 Gingras ..... E04B 1/34321 52/582.1
8,584,405 B2 * 11/2013 Broden ..... E04H 3/08 52/79.9
8,650,807 B2 * 2/2014 McKimmy ..... E04B 1/34321 52/79.9
8,726,579 B2 * 5/2014 Peck ..... E04B 1/08 52/79.1
8,745,931 B2 * 6/2014 Hutter ..... E04B 1/355 52/79.5
8,752,339 B1 * 6/2014 Tubbs ..... E06B 3/5072 52/79.5
8,892,457 B2 * 11/2014 Laskowski ..... G06Q 20/40 705/13
8,943,760 B2 * 2/2015 Okuda ..... E04H 1/1205 135/159
8,959,859 B2 * 2/2015 Haan ..... E04B 2/7453 52/309.1
8,991,134 B2 * 3/2015 Wheeler ..... E04B 1/34321 220/4.27
9,016,002 B2 * 4/2015 Segall ..... E04B 1/34326 52/79.5
9,157,249 B2 * 10/2015 Segall ..... E04B 1/34321
9,206,595 B2 * 12/2015 Rutledge ..... E04B 1/34315
9,206,827 B2 * 12/2015 Loree ..... A47B 96/02
9,303,683 B1 * 4/2016 Newcomb, Jr. ..... E04B 1/34321
9,382,721 B2 * 7/2016 Morta ..... F41H 5/24
9,534,407 B2 * 1/2017 Ballantyne ..... E04H 15/50
9,693,478 B2 * 6/2017 Ivey ..... A47B 46/005
10,260,211 B2 * 4/2019 Peterson ..... E04B 1/24
10,323,404 B2 * 6/2019 Hedler ..... E04B 1/3211
10,426,102 B2 * 10/2019 Smith ..... E04B 1/34321
10,533,340 B1 * 1/2020 Ohanesian ..... E04H 17/1417
10,787,803 B2 * 9/2020 Leahy ..... E04B 1/61
10,808,414 B2 * 10/2020 McClendon ..... E04B 1/3441
11,098,475 B2 * 8/2021 Collins ..... E04B 1/2403
11,174,633 B2 * 11/2021 Mordechai ..... E04B 1/6145
11,473,288 B2 * 10/2022 Kolisnek ..... E04C 2/292
11,753,815 B2 * 9/2023 Thomas, Sr. ..... E04B 1/6108 52/204.1
11,840,836 B2 * 12/2023 Ohanesian ..... E04B 2/76
12,245,689 B1 * 3/2025 Meehan ..... A47B 57/34
12,297,076 B2 * 5/2025 Collins ..... B66B 7/023
12,385,244 B2 * 8/2025 Yehia ..... C04B 28/02
2002/0130598 A1 9/2002 Schmidt
2004/0060245 A1 * 4/2004 Loblick ..... E04C 2/20 52/592.1
2008/0110484 A1 * 5/2008 Doran ..... E04B 1/34315 135/121
2009/0217600 A1 * 9/2009 De Azambuja .... B65D 90/0006 52/79.5
2010/0050556 A1 * 3/2010 Burns ..... E04B 1/34321 52/592.1
2010/0269419 A1 * 10/2010 Gyory ..... E04B 1/34384 52/79.5
2011/0011010 A1 * 1/2011 Mower ..... E04B 7/20 52/79.5
2011/0234059 A1 9/2011 Ellerbe, II
2012/0110926 A1 * 5/2012 Phillips ..... E04H 1/1205 52/79.9
2012/0266544 A1 * 10/2012 Lazarovits ..... A47K 3/325 52/79.1
2012/0311940 A1 * 12/2012 Medley ..... E04B 1/3444 52/79.5
2013/0067846 A1 * 3/2013 Kvols ..... E04B 1/34315 52/586.1
2013/0186010 A1 * 7/2013 Condie ..... E04H 1/005 52/79.5
2014/0182219 A1 * 7/2014 Thuma ..... E04B 1/34321 52/79.5
2014/0259976 A1 * 9/2014 Bowers ..... E04H 9/14 52/79.5
2015/0121776 A1 * 5/2015 Peterson ..... E04B 1/762 52/79.5
2016/0145852 A1 * 5/2016 Ito ..... E04H 1/1205 52/282.1
2017/0282349 A1 10/2017 Zhao
2018/0142459 A1 * 5/2018 Vogler ..... E04B 1/34321
2020/0181918 A1 * 6/2020 Auer ..... E04B 1/34321
2022/0120077 A1 * 4/2022 Lawson ..... E04C 2/38
2022/0396947 A1 * 12/2022 Moore ..... E04B 1/3442
2023/0120060 A1 * 4/2023 Stapleton ..... E04B 1/3483 52/79.5
2024/0060295 A1 * 2/2024 Zhou ..... E04B 2/72

FOREIGN PATENT DOCUMENTS

CN 216852656 U * 6/2022
CN 115107555 A * 9/2022 ..... B60L 53/30
CN 115492245 A * 12/2022
CN 117569457 A * 2/2024
CN 117905313 A * 4/2024
CN 118975904 A * 11/2024
CN 119122145 A * 12/2024
FR 3027040 A1 * 4/2016 ..... E04B 1/34321
GB 191300501 A * 5/1913
GB 664405 A * 1/1952
KR 100519501 B1 * 6/2004
KR 200354388 Y1 * 6/2004
KR 20220121581 A * 9/2022
NL 1037134 C2 * 1/2011
WO WO-9943901 A1 * 9/1999 ..... E04B 1/34321
WO WO-0202883 A1 * 1/2002 ..... B65D 11/1873
WO WO-2004106656 A1 * 12/2004 ..... E04B 1/34321
WO WO-2016093578 A1 * 6/2016 ..... E04B 1/343
WO WO-2017156016 A1 * 9/2017 ..... E04B 1/34321
WO WO-2022047464 A1 * 3/2022 ..... E04B 1/34331
WO WO-2022076924 A1 * 4/2022 ..... E04B 1/34321

* cited by examiner

VERTICAL TOOL SHED

TECHNICAL FIELD

The invention relates to the technical field of mobile houses, in particular to a vertical tool shed.

BACKGROUND

A tool shed is a small mobile house used to store various tools. The tool shed is provided to facilitate storage of various tools and has a wide range of use scenarios. The tool shed is generally assembled from profiles and profiled steel plates. At present, the tool sheds on the market have the following defects: the structure is relatively complex, the profiles or profiled steel plates are fixed by welding, and the formed tool shed is not easy to transport or transfer, which is not conducive to recycling; and since the area of the tool shed is limited, in order to facilitate the storage of more tools, hook structures are usually provided on wall plates, and the tools are hung on the wall plates. However, such hook structures are not easy to disassemble, and complex in structure, which increases the difficulty of production.

SUMMARY

An object of the present invention is to provide a vertical tool shed designed to solve the above-mentioned technical deficiencies.

The invention relates to a vertical tool shed which includes a top plate, a bottom plate, a back plate, two side plates, two door plates and four upright columns, where the four upright columns are connected to the bottom plate, the back plate and the side plates are connected by the upright columns, the two door plates are located between the two upright columns located at a front, the two door plates are split type, an inner wall of each door plate is provided with a mounting plate, the mounting plate is provided with a hook assembly, an inner wall of the back plate is provided with a detachable storage plate assembly, and the inner wall of the back plate or an inner wall of the side plate is provided with a detachable hanging assembly.

The invention has the following technical effects: the tool shed consists of plate structures such as the top plate, the side plate, the back plate, the upright columns and the door plates, so the overall structure is simple and easy to mount; the inner walls of the side plate, the back plate and the door plate are provided with a plurality of hook assemblies for hanging, and these hook assemblies are not only simple in structure, but also detachably mounted, and adjustable in mounting position, which is very flexible and convenient. In addition, these hook assemblies are simple in structure and convenient to assemble and disassemble, and occupy a very little space in the tool shed after mounting.

DESCRIPTION OF THE EMBODIMENTS

The technical solutions in the embodiments of the present invention will be clearly and completely described below in conjunction with the accompanying drawings in the embodiments of the present invention. Obviously, the described embodiments are only part but not all of the embodiments of the present invention. All other embodiments obtained by a person of ordinary skill in the art based on the embodiments of the present invention without creative efforts shall fall within the protection scope of the present invention.

Figure 1:
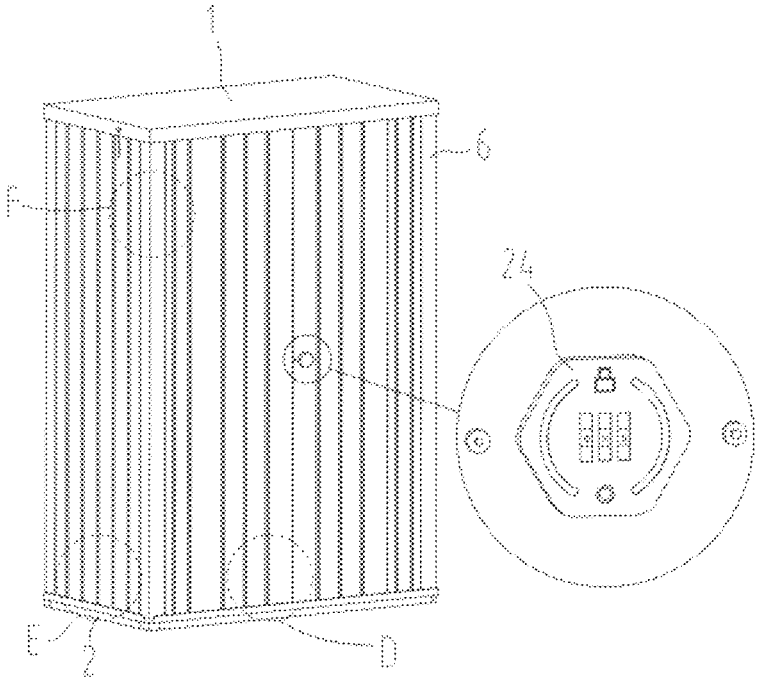
FIG. 1 is an overall structural diagram of the present invention with a door plate closed.
Figure 2:
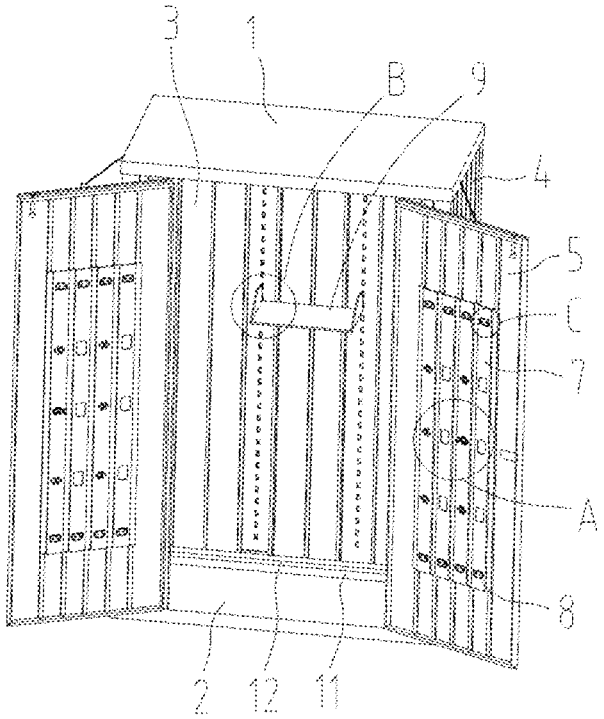
FIG. 2 is an overall structural diagram of the present invention with the door plate opened.

As shown in FIGS. 1 and 2, the invention includes a top plate 1, a bottom plate 2, a back plate 3, two side plates 4, two door plates 5 and four upright columns 6, the bottom plate 2 is a rectangular plate, the four upright columns 6 are connected to four corners of the bottom plate 2, the back plate 3 and the side plates 4 are connected by the upright columns 6, and the two door plates 5 are located between the two upright columns 6 located at a front to form a tool shed in the shape of a rectangular parallelopiped. The two door plates 5 are split-type door plates 5, an inner wall of each door plate 5 is provided with a mounting plate 7, the mounting plate 7 is a long strip-shaped plate body structure, and is arranged along a length direction of the door plate 5, and the mounting plate 7 is provided with a detachable hook assembly 8; an inner wall of the back plate 3 is provided with a detachable storage plate assembly 9; and the inner wall of the back plate 3 or an inner wall of the side plate 4 is provided with a detachable hanging assembly 10, and the hook assembly 8 and the storage plate assembly 9 namely the hanging assembly 10 are used for hanging tools.

The back plate 3, the side plates 4 and the door plates 5 are all metal corrugated plates or steel plates, and a respective inner wall surface thereof forms a concave-convex surface structure.

Figure 10:
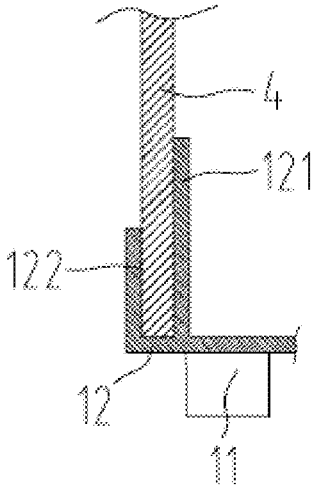
FIG. 10 is a longitudinal sectional view of a rib located at a lower end of a side plate, corresponding to position E in FIG. 1.

Peripheries of the bottom plate 2 and the top plate 1 are provided with ribs 12, the ribs 12 each include two extended verges 121, the verge 121 of the rib 12 located at the bottom plate 2 is arranged upward, the verge 121 of rib 12 located at the top plate 1 is arranged downward, and a mounting groove 122 is formed between the two verges 121. As shown in FIG. 10, upper and lower ends of the side plate 4 and upper and lower ends of the back plate 3 are inserted into the corresponding mounting grooves 122, where the periphery of the bottom plate 2 is provided with a raised edge 11 in the shape of a square tube for reinforcing the edge of the bottom plate 2, the raised edge 11 is located below the rib 12, and an edge of the rib 12 is bent upward to form the verge 121, which ensures fit between the upper and lower ends of the side plate 4 and the back plate 3 and the rib 12, so that the connection is more stable, thus ensuring the mounting strength of the side plate 4 and the back plate 3. In the present embodiment, the four edges of the bottom plate 2 are located between the raised edge 11 and the rib 12, the raised edge 11 is located at the bottom, and the raised edge 11 may be a square tube or a square tube-shaped structure formed by bending a profiled plate.

Figure 9:
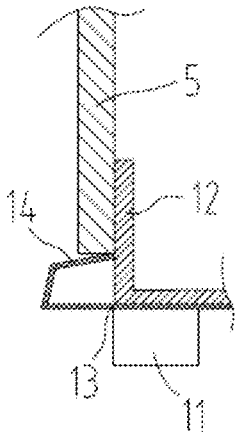
FIG. 9 is a longitudinal sectional view of a rib located at a lower end of a door plate, corresponding to position D in FIG. 1.

Upper and lower ends of the door plate 5 are located on an outer side of the a corresponding rib 12, an intermediate layer 13 is provided between the bottom plate 2 and the raised edge 11, the intermediate layer 13 is also a plate body structure, and the intermediate layer 13 may be a thin plate having the same size as the bottom plate 2, or may be a strip-shaped thin plate having the same width as the raised edge 11. A front end of the intermediate layer 13 extends to a lower portion of the door plate 5 and undergoes upward bending followed by inward bending, thus forming a stop strip 14. As shown in FIG. 9, that is, the stop strip 14 is formed by bending the front end of the intermediate layer 13 twice. In the present embodiment, the stop strip 14 is bent on both sides to form a groove-shaped steel structure, an end portion of the stop strip 14 abuts against the outer side of the rib 12, and a surface of the stop strip 14 undergoing bending twice abuts against a bottom end of the door plate 5, which can not only block the door plate 5, but also serve as a threshold to isolate a bottom portion of the door plate 5 to prevent rainwater from entering the shed and strengthen the strength of the edge of the bottom plate 2.

The mounting plate 7 is a metal corrugated plate, a surface thereof forms a concave-convex surface structure, a convex surface structure on the back of the mounting plate 7 is fitted with a convex surface structure of the door plate 5 and they are fixedly connected by fasteners such as rivets or screws. The mounting plate 7 is a thin plate structure, and the mounting plate 7 is provided with a hook assembly 8 integrated with the mounting plate 7.

Figure 3:
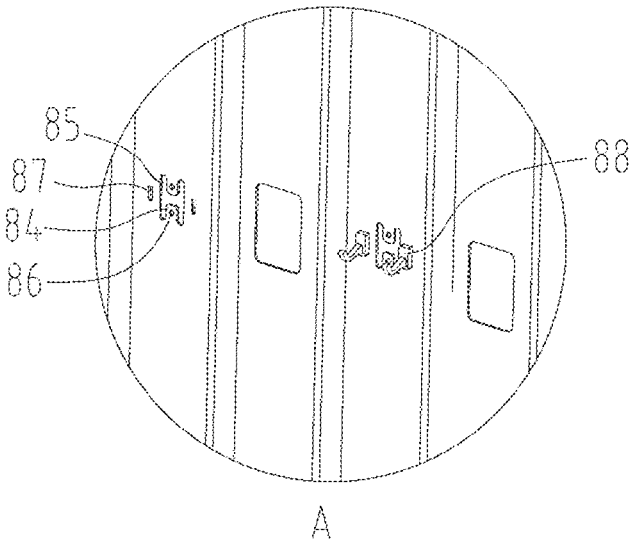
FIG. 3 is an enlarged view of A in FIG. 2.
Figure 4:
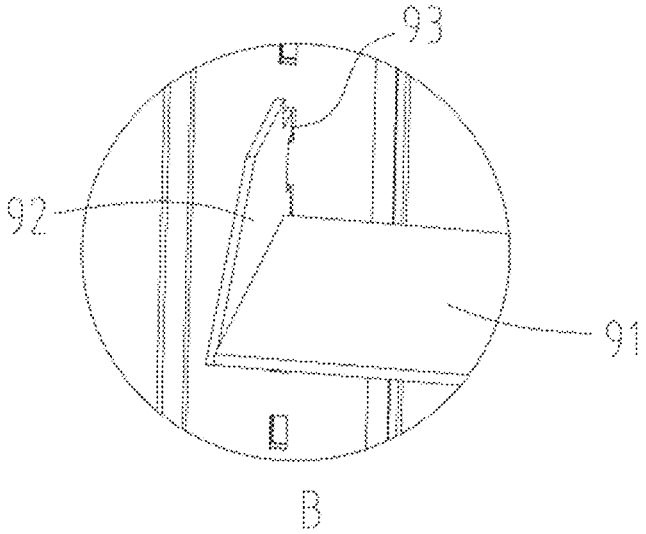
FIG. 4 is an enlarged view of B in FIG. 2.

In the present embodiment, the hook assembly 8 can be in various forms: the first form is as shown in FIG. 4, where the hook assembly 8 is a first hook 81, a U-shaped first groove body 82 is cut from a front surface of the mounting plate 7, a portion of the first groove body 82 surrounding the mounting plate 7 serves as the first hook 81, the first hook 81 can be tilted and bent relative to the mounting plate 7, the first hook 81 is provided with a first hook hole 83, the first hook 81 is bent to a horizontal direction, that is, the first hook 81 is at a 90 degree angle to the mounting plate 7, so that the first hook hole 83 can be used to hang hook-shaped members; the first hook 81 is provided with a row of small holes along a bending line to facilitate bending of the first hook 81; the second form is as shown in FIG. 3, where the hook assembly 8 is a second hook 84, an H-shaped second groove body 85 is cut from the front surface of the mounting plate 7, a portion of the second groove 85 surrounding the mounting plate 7 is used as the second hook 84, the second hook 84 is provided with a second hook hole 86, and the mounting plate 7 is provided with mounting holes 87 on both sides of the second hook 84; external hook members 88 are detachably inserted into the mounting holes 87, that is, tools are hung on the second hook hole 86 through the hook-shaped members, and the external hook members 88 can be used as hook-shaped members to directly hang the tools, so it is suitable for different hanging needs; and the third form is that the mounting plate 7 is provided with a second hook hole 86 as a third hook, which is a hook hole structure with a large area, and in the present embodiment, the third hook is a rectangular hook hole structure, which is convenient for hanging tools with relatively large volumes. One or more of the above three hook assemblies 8 may be freely combined and arranged on the mounting plate 7. In the present embodiment, each hook is arranged horizontally on the mounting plate 7, and the mounting position can be freely selected and combined.

Figure 5:
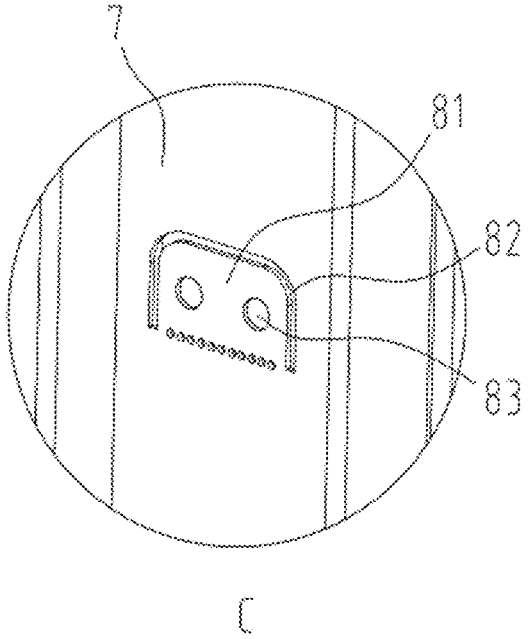
FIG. 5 is an enlarged view of C in FIG. 2.

The inner wall of the back plate 3 is provided with a positioning plate 15, and the positioning plate 15 has a plurality of insertion holes 151 even distributed along a height direction thereof in a straight line; the storage plate assembly 9 includes a storage plate 91, as shown in FIG. 5, two sides of the storage plate 91 are provided with side wings 92 perpendicular to the storage plate 91, the side wings 92 are integrated with the storage plate 91, back ends of the side wings 92 each is provided with a plug-in end 93 integrated with the side wings 92, the plug-in end 93 is provided with a barb, after the plug-in end 93 is inserted into the insertion hole 151, a lateral side of the storage plate 91 is supported by the back plate 3, and an upper portion of the storage plate 91 is fixed by the plug-in end 93, so that the storage plate 91 can be hung on the back plate 3 horizontally, and since the plug-in end 93 can be plugged from the insertion hole 151, the storage plate 91 can be detachably snapped and mounted on the positioning plate 15, and can be adjusted in position along the height direction, thus meeting the requirements of different quantities and different heights of the storage plates 91.

Figure 11:
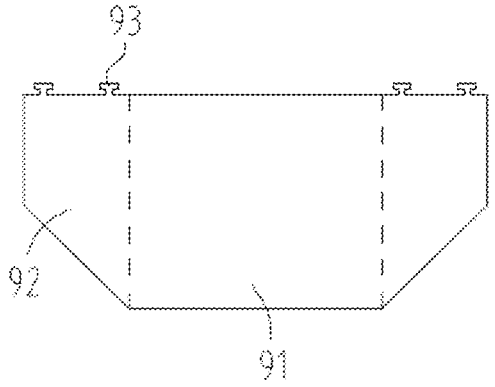
FIG. 11 is a schematic structural diagram of a storage plate assembly in an unbent state.
Figure 12:
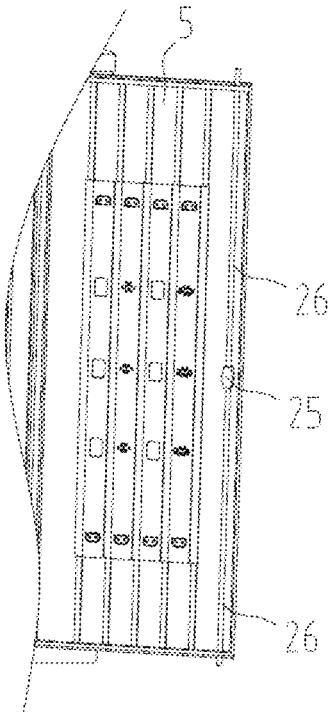
FIG. 12 is a schematic structural diagram of the door plate with a rotating member and a positioning rod provided thereon.

In addition, as shown in FIG. 11, a row of small holes as creases are provided between the side wings 92 and the storage plate 91, so that the side wings 92 can be bent relative to the storage plate 91, and the side wings 92 can be bent to 90 degrees relative to the storage plate 91 or can be bent to the same horizontal plane as the storage plate 91. When the side wings 92 and the storage plate 91 are in the same horizontal plane, that is, in an unbent state, the storage plate assembly 9 can be conveniently stacked and transported; and when mounting is required, only the side wings 92 are bent.

Figure 6:
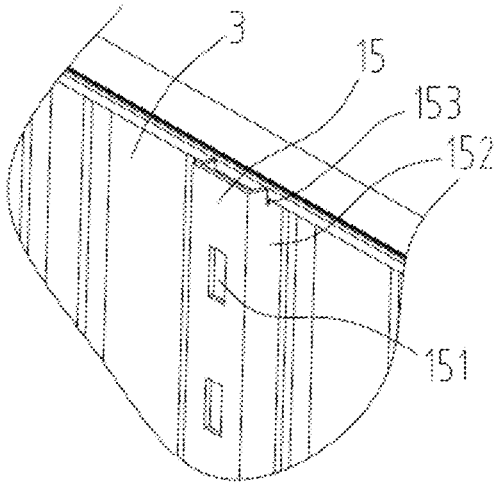
FIG. 6 is a structural diagram of a positioning plate.

Further, as shown in FIG. 6, both sides of the positioning plate 15 are bent in the direction of the back plate 3 to form side edges 152, the side edges 152 are fixed to the back plate 3 by fasteners such as rivets or screws, a top end and a bottom end of the side edge 152 each are provided with a slot 153, and the rib 12 located at the top plate 1 and the rib 12 located at the bottom plate 2 are respectively inserted into the corresponding slots 153, which not only can limit the positioning plate 15, but also can adjust the position of the positioning plate 15 along a length direction of the rib 12, thus adjusting a lateral position of the storage plate 91. Such structure is simple, flexible and convenient.

Figure 7:
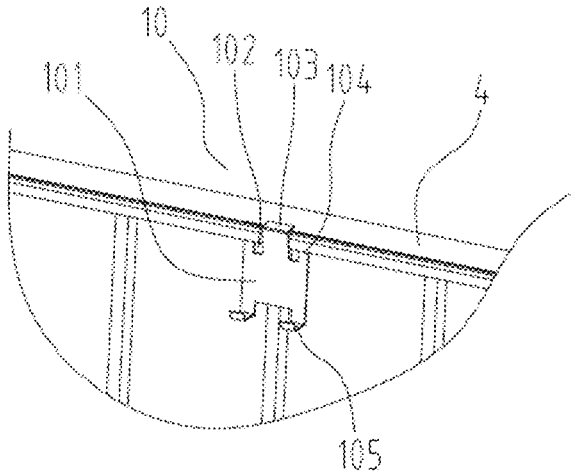
FIG. 7 is a structural diagram of a hanging assembly.

As shown in FIG. 7, the hanging assembly 10 includes a hanging seat 101, two vertical first cutting grooves 102 are cut from a top portion of the hanging seat 101, and a portion of the hanging seat 101 between the two first cutting grooves 102 is bent backward in a horizontal direction to form a pressing seat 103, and the pressing seat 103 is inserted between the top plate 1 and the side plate 4 or between the top plate 1 and the back plate 3; a portion of the hanging seat 101 outward of the two first cutting grooves 102 forms a vertical insertion piece 104, and the insertion piece 104 is inserted between the rib 12 and the side plate 4 or between the rib 12 and the back plate 3, the hanging seat 101 is detachably hung on the side plate 4 or the back plate 3, and a bottom portion of the hanging seat 101 is bent forward to form a hanging portion 105, that is, the hanging seat 101 is first inserted between the top plate 1 and the side plate 4 or inserted between the top plate 1 and the back plate 3 through the pressing seat 103, and then vertically inserted between the rib 12 and the side plate 4 or between the rib 12 and the back plate 3 through the insertion piece 104 from bottom to top, so that the hanging seat 101 can be stably hung on a top portion of the side plate 4 or the back plate 3, which is also convenient to disassemble.

Figure 8:
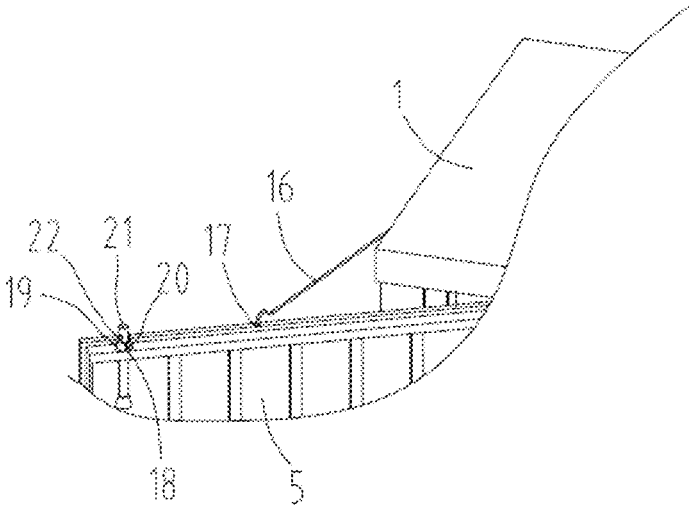
FIG. 8 is a structural diagram of a windproof hook and a movable pin.

Further, as shown in FIG. 8, the top plate 1 or the side plate 4 is provided with a windproof hook 16, a top portion of the door plate 5 is provided with a first hole 17, and when the door plate 5 is completely opened, a hook end of the windproof hook 16 is inserted into the first hole 17 on the top portion of the door plate 5, thus positioning the door plate 5 and preventing the door plate 5 from being blown by the wind; the top portion of at least one of the door plates 5 is also provided with a second hole 18, the at least one door plate 5 is provided with first limit blocks 19 distributed in an annular array at an edge of the second hole 18, a gap 20 is left between adjacent first limit blocks 19, a movable pin 21 is inserted in the second hole 18, and second limit blocks 22 distributed in an annular array are provided on a peripheral wall of the movable pin 21, and a width of the second limit block 22 is smaller than a width of the gap 20; when the movable pin 21 is rotated until the second limit blocks 22 are located above the first limit blocks 19, a top portion of the movable pin 21 is in an extended state, that is, the top portion of the movable pin 21 extends to one side of the rib 12, thus locking at least one the door plate 5 and the top plate 1, so that the door plate 5 will not be opened outwards; and when the second limit blocks 22 are rotated with the movable pin 21 to slide into the gap 20, the top portion of the movable pin 21 changes from the extended state to a retracted state, thus unlocking the door plate 5 and the top plate 1.

Figure 13:
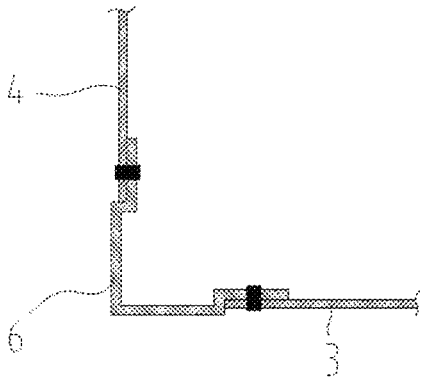
FIG. 13 is a schematic diagram of connection between an upright column, the side plate and the back plate, corresponding to position F in FIG. 1.

In another embodiment, in addition to the pin structure like the movable pin 21 described above, another pin structure can also be used between the door plate 5 and the top plate 1 or between the door plate 5 and the bottom plate 2. As shown in FIG. 13, the pin structure includes a rotating member 25 and a positioning rod 26; the rotating member 25 is located on an inner side of at least one of the door plates 5 and is rotatably connected to said door plate 5; and one end of the rotating member 25 located on an outer side of the door plate 5 serves as a rotating end, and the rotating member 25 is transmission connected with the positioning rod 26. In the present embodiment, there are two positioning rods 26 which are symmetrically arranged on upper and lower sides of the rotating member 25; the rotating member 25 is located at a center position of a height direction of the door plate 5, and the two positioning rods 26 are synchronously extended and retracted through rotation of the rotating member 25; the top plate 1 and the bottom plate 2 are correspondingly provided with positioning holes for the upper and lower positioning rods 26 to be inserted, and the positioning rods 26 extend from the rotating member 25 to be close to the positioning holes; and the upper and lower positioning rods 26 are controlled to be synchronously extended and retracted in the positioning holes by rotating the rotating member 25 forward and backward, thus realizing locking or unlocking of the door plate 5.

As shown in FIG. 1, an outer wall of the other door plate 5 is provided with a combination lock 24, the door plate 5 is first unlocked by the combination lock 24, after the door plate 5 is opened, and the movable pin 21 on the top of the other door plate 5 is manually unlocked, so that both door plates 5 are opened. The advantage of using the combination lock 24 is that there is no need to carry a key with you, so there is no need to worry about losing the key, and it is convenient for many people to use. The combination lock 24 is a conventional digital combination lock, and the specific structure will not be described here.

It should be noted that, as shown in FIG. 13, the upright column 6 includes two lateral plates 23 at a vertical angle, the lateral plates 23 extend along a height direction of the side plates 4, the side plates 4 and the back plate 3 are respectively fitted to the corresponding lateral plate 23, and then fixedly connected by fasteners such as rivets to form front and rear limits for the side plates 4 and the back plate 3, so that the connection between the side plates 4 and the back plate 3 is more stable.

Corner connectors are used between the top portion of the side plate 4 and the upright column 6 and between the top portion of the back plate 3 and the upright column 6 to reinforce connection. In the present embodiment, the corner connector has three surfaces to form a triangular pyramid structure, and the three surfaces are respectively fitted to the top portion of the top plate 1 and top positions of the two lateral plates 23 along the upright column 6, and are fixedly connected by fasteners such as rivets or screws, thus strengthening junctions of the top plate 1, the side plate 4, the back plate 3 and the upright column 6.

Figure 14:
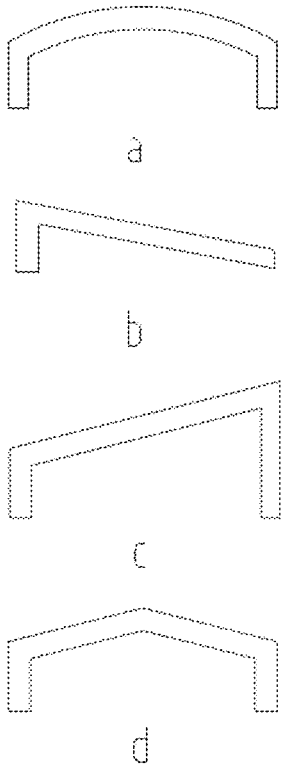
FIG. 14 is a schematic diagram of four shapes of a top plate.

The top plate 1 may have different shapes, and four shapes are exemplified in FIG. 14. In a, a top surface of the top plate 1 has an outwardly convex arc shape; in b, the top plate 1 consists of one vertical side surface and another tilted side surface; in c, the top plate 1 consists of two vertical side surfaces and one tilted top surface; and in d, the top surface of the top plate 1 is an outwardly convex triangle. The advantages of designing the top plate 1 in these four shapes are that water will not accumulate and the top portion is convenient to clean.

What is claimed is:

1. A vertical tool shed, comprising a top plate, a bottom plate, a back plate, two side plates, two door plates and four upright columns, wherein the four upright columns are connected between the bottom plate and the top plate, the back plate and the side plates are respectively mounted between the two upright columns located at a rear and at a side of the shed, and the two door plates are located between two upright columns located at a front of the shed and form a split opening, an inner wall of each door plate is provided with a mounting plate, the mounting plate is provided with a hook assembly, an inner wall of the back plate is provided with a detachably connected storage plate assembly, and the inner wall of the back plate or an inner wall of the side plate is provided with a detachably connected hanging assembly;

edges of the bottom plate and the top plate are provided with ribs, the ribs each include two extended verges, and a mounting groove is formed between the two verges for an end portion of a side plate or the back plate to be inserted therein;

the back plate is provided with a positioning plate, and the positioning plate has a plurality of insertion holes evenly distributed along a height direction thereof in a straight line; and the storage plate assembly comprises storage plates, two sides of each storage plate are provided with side wings perpendicular to the storage plates, and rear ends of the side wings are provided with a plug-in end for being inserted into the insertion holes, the storage plate is detachably snapped on the positioning plate and can be adjusted in position along the height direction of the positioning plate;

a row of small holes as creases are provided between the side wings and the storage plate, and the side wings are bent to 90 degrees relative to the storage plate or to the same horizontal plane as the storage plate;

both sides of the positioning plate are bent to form side edges, slots are provided on the side edges, and the ribs located at the top plate and the ribs located at the bottom plate are respectively inserted into corresponding slots, the positioning plate can be adjusted in position along a length direction of the ribs;

the hanging assembly comprises a hanging seat, the hanging seat is provided with two first cutting grooves, and the hanging seat located between the two first cutting grooves is bent backward to form a pressing seat, and the pressing seat is inserted between the top plate and one side plate or between the top plate and the back plate; and an insertion piece is formed on an outer side of the first cutting groove, and the insertion piece is inserted between the rib and the side plate or between the rib and the back plate, the hanging seat is detachably hung on one side plate or the back plate, and an end portion of the hanging seat away from the pressing seat is bent forward to form a hanging portion;

the top plate or one of the side plates is provided with a windproof hook, and a top portion of each door plate is provided with a first hole for hooking the windproof hook; and when each door plate is completely opened, a hook end of the windproof hook is inserted into the first hole on the top portion of each door plate, thus positioning each door plate;

the top portion of at least one of the door plates is further provided with a second hole, the at least one door plate is provided with first limit blocks at an edge of the second hole, a gap is left between adjacent first limit blocks, a movable pin is inserted into the second hole, second limit blocks are provided on a peripheral wall of the movable pin, and a width of each second limit block is less than a width of the gap; when the movable pin is rotated to cause the second limit blocks to be located above the first limit blocks, a top portion of the movable pin is in an extended state, and the at least one door plate and the top plate are locked; and when the second limit blocks rotate with the movable pin and slide into the gap, the top portion of the movable pin changes from the extended state to a retracted state, the at least one door plate and the top plate are unlocked; and both the top plate and the bottom plate are provided with positioning holes, at least one of the door plates is provided with a rotating member and a positioning rod, the rotating member is located on an inner side of the at least one of the door plates and rotatably connected to said door plate, one end of the rotating member located on an outer side of each door plate serves as a rotating end, there are two positioning rods which are symmetrically arranged on both sides of the rotating member, and the two positioning rods are transmission connected with the rotating member, there are two positioning rods which are symmetrically arranged on upper and lower sides of the rotating member; the rotating member is located at a center position of a height direction of each door plate, and the two positioning rods are synchronously extended and retracted through rotation of the rotating member; the top plate and the bottom plate are correspondingly provided with positioning holes for the upper and lower positioning rods to be inserted, and the positioning rods extend from the rotating member to be close to the positioning holes; and the upper and lower positioning rods are controlled to be synchronously extended and retracted in the positioning holes by rotating the rotating member forward and backward, thus realizing locking or unlocking of the door plates.

2. The vertical tool shed according to claim 1, wherein the back plate, the side plates and the door plates are all metal corrugated plates, and a respective inner wall surface thereof forms a concave-convex surface structure.

3. The vertical tool shed according to claim 2, wherein the mounting plate is a metal corrugated plate, a surface thereof forms a concave-convex surface structure, and the hook assembly is integrally formed on the mounting plate.

4. The vertical tool shed according to claim 3, wherein the hook assembly is formed by freely combining one or more of a first hook, a second hook and a third hook on the mounting plate;

a U-shaped first groove body is cut from a front surface of the mounting plate, the first hook is arranged on an inner side of the first groove body, the first hook can be tilted and bent relative to the mounting plate, and a first hook hole is provided on the first hook;

an H-shaped second groove body is cut on the front surface of the mounting plate, one side of the second groove body is provided with the second hook, and a second hook hole is provided on the second hook, and a mounting hole is provided on the mounting plate, and an external hook member is detachably inserted into the mounting hole; and the hook assembly serves as the third hook.

5. The vertical tool shed according to claim 1, wherein an edge of the bottom plate is further provided with a raised edge, a rib is located on an outer side of each raised edge, and a height of the verge is higher than the raised edge; the door plates are each located on an outer side of a corresponding rib, an intermediate layer is provided between the bottom plate and the raised edge, and the intermediate layer extends to a lower portion of the door plates and then sequentially bent upward and inward twice to form a stop strip; and an end portion of the stop strip abuts against the outer side of a rib, and a bottom end of each door plate abuts against the stop strip.

6. The vertical tool shed according to claim 1, wherein each upright column comprises two lateral plates perpendicular to each other, and the side plates and the back plate are respectively connected to the lateral plates.

* * * * *